US006735908B2

(12) United States Patent
Edwards

(10) Patent No.: US 6,735,908 B2
(45) Date of Patent: May 18, 2004

(54) STRADDLE BIN

(75) Inventor: John R. Edwards, Nobleton (CA)

(73) Assignee: Inscape Corporation, Holland Landing (CA)

( * ) Notice: Subject to any disclaimer, the term of this patent is extended or adjusted under 35 U.S.C. 154(b) by 60 days.

(21) Appl. No.: 10/126,519

(22) Filed: Apr. 22, 2002

(65) Prior Publication Data

US 2003/0196388 A1 Oct. 23, 2003

(51) Int. Cl.[7] ..... E04H 1/00

(52) U.S. Cl. ..... 52/36.1; 52/239; 52/220.1; 52/220.7

(58) Field of Search ..... 52/36.1, 239, 220.1, 52/220.7; 160/19, 85, 354, 368.1, 371; 312/242, 245

(56) References Cited

U.S. PATENT DOCUMENTS

| | | | | |
|---|---|---|---|---|
| 2,027,491 A | | 1/1936 | Percy | |
| D120,370 S | | 5/1940 | Bach | |
| D148,188 S | | 12/1947 | Robert | |
| D156,109 S | | 11/1949 | Johnson | |
| 3,395,959 A | | 8/1968 | White | |
| 3,765,740 A | * | 10/1973 | Mastrangelo | 312/107 |
| 4,076,350 A | | 2/1978 | Crist | |
| 4,535,577 A | | 8/1985 | Tenser | |
| 4,685,255 A | | 8/1987 | Kelley | |
| 4,940,299 A | | 7/1990 | Lazenby | |
| 4,953,327 A | | 9/1990 | Cohodar | |
| D312,014 S | | 11/1990 | Friedman | |
| 5,038,539 A | | 8/1991 | Kelley et al. | |
| 5,191,747 A | | 3/1993 | Tengquist et al. | |
| 5,406,760 A | * | 4/1995 | Edwards | 52/239 |
| 5,487,246 A | | 1/1996 | Hodges | |
| D441,566 S | | 5/2001 | Martin et al. | |
| D449,748 S | | 10/2001 | Martin et al. | |

FOREIGN PATENT DOCUMENTS

| | | |
|---|---|---|
| CA | 2350427 | 12/2002 |
| NL | 1008453 | 9/1999 |

* cited by examiner

*Primary Examiner*—Jeanette Chapman
(74) *Attorney, Agent, or Firm*—Riches, McKenzie & Herbert LLP

(57) ABSTRACT

A straddle bin for an office furniture system with walls comprised of modular partitions. The straddle bin provides two adjacent compartments extending through an office partition with one compartment open to a first side of the partition only and the other compartment open to a second side of the partition only, and with sliding doors on each side of the partition to close the compartment opening on that side and when open, to lie over a blind, closed rear end of the adjacent compartment. The straddle bin provides private compartments for users on both sides of the partition.

17 Claims, 10 Drawing Sheets

1
10
2
39
1
19
3
2
3

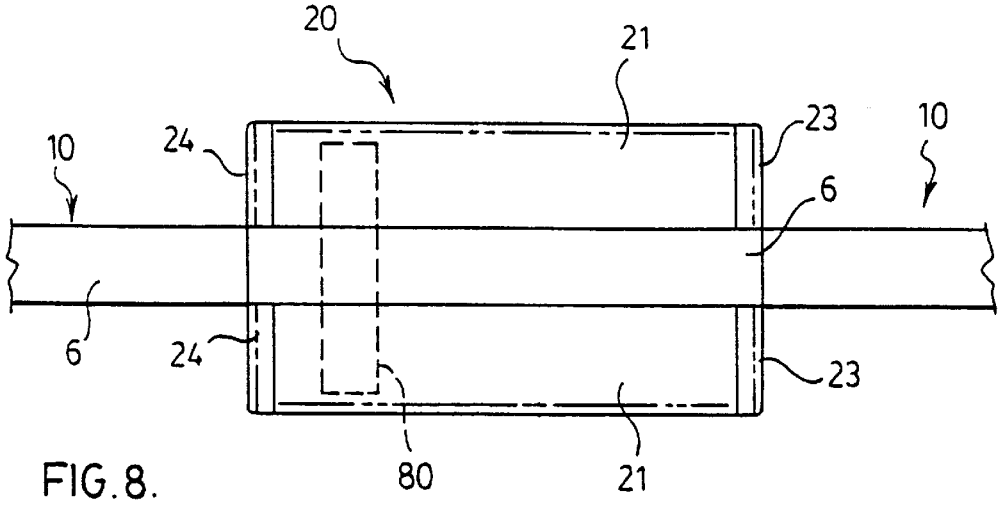
FIG. 8.
FIG. 9.
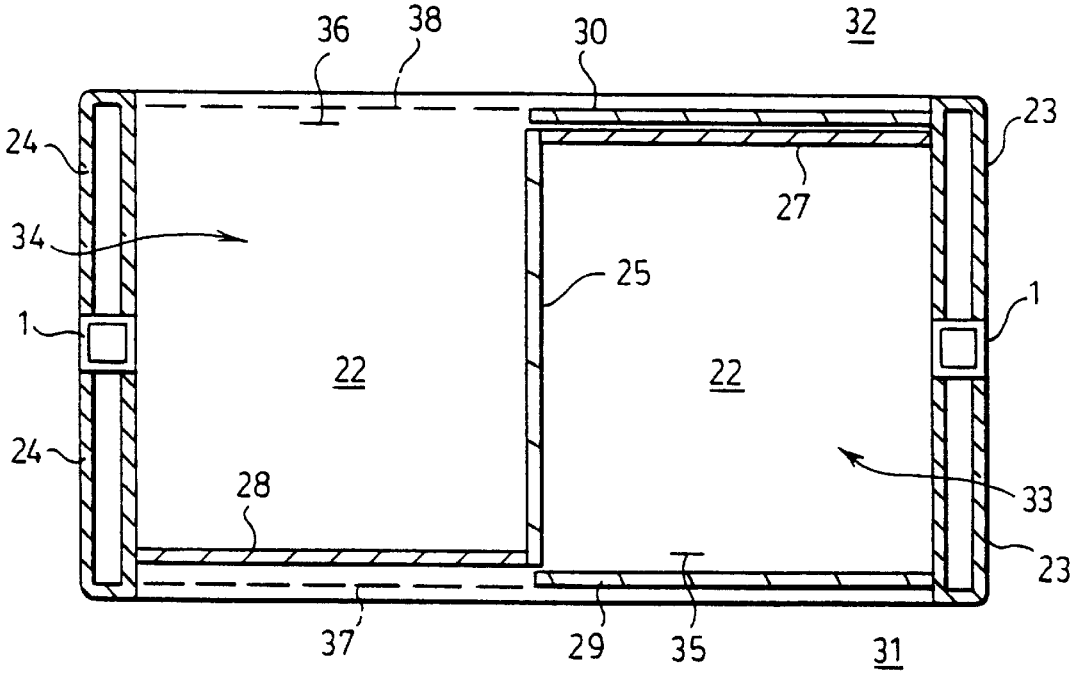

STRADDLE BIN

SCOPE OF THE INVENTION

This invention relates to storage bins for office wall partitions and, more particularly, to a storage bin configuration for use on both sides of a office wall partition in a modular office furniture system.

BACKGROUND OF THE INVENTION

Office furniture partitions are known which comprise modular partitions joined end-to-end. Each partition typically comprises a rectangular frame with vertical posts and horizontal beams to which cladding such as a plurality of modular covers are removably coupled. Examples of such partitions include U.S. Pat. No. 5,406,760 to Edwards, issued Apr. 11, 1995; U.S. Pat. No. 4,685,255 to Kelley, issued Aug. 11, 1987; U.S. Pat. No. 5,487,246 to Hodges et al, issued Jan. 30, 1996, and U.S. Pat. No. 4,535,577 to Tenser et al, issued Aug. 20, 1985, the disclosures of which are incorporated herein by reference.

Such partitions are known for use with associated office furniture including, for example, hanging cabinets which are hung on the front of the partition. Such hanging cabinets have the disadvantage that they extend a substantial extent in front of the partition and typically require lighting under the cabinet. The cabinet impedes a user's ability to use the workplace and are relatively expensive.

Overhead cabinets have doors which typically hinge outwardly and require additional space and provide interference with use of the cabinet and the workspace. Sliding doors are known to close cabinets, closets and the like in which two sliding doors are provided, however, such double sliding door configurations have the disadvantage that, at all times, at least one of the doors covers half of the opening.

SUMMARY OF THE INVENTION

To at least partially overcome these disadvantages, the present invention provides two adjacent, separated compartments extending through an office partition with a first compartment open to a first side of the partition only and another, second compartment open to a second side of the partition only, and with one sliding door on each side of the partition to close the compartment opening on that side and when open, to lie over a blind, closed rear end of the adjacent compartment. The straddle bin provides separate, private compartments for users on both sides of the partition.

An object of the present invention is to provide an improved overhead compartment or bin which permits use of the interior space in a partition for storage.

Another object is to provide an individual, private storage compartment to users on both sides of an office partition.

Another object is to provide a storage compartment with a sliding door which slides entirely out of the way to access a storage compartment.

Accordingly, the present invention in one of its aspects provides a modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having a horizontal top wall, a horizontal bottom wall spaced vertically from the top wall, a vertical first end wall extending between the top wall and the bottom wall at a first end of the storage element and a vertical second end wall extending between the top wall and the bottom wall at a second end of the storage element parallel to the first end wall, a vertical dividing wall intermediate the first end wall and the second end wall parallel to the first end wall, a vertical first side wall at the second side of the partition spanning from the first end wall to the dividing wall between the top wall and the bottom wall, a vertical second side wall at the first side of the partition spanning from the second end wall to the dividing wall between the top wall and the bottom wall, a first storage compartment enclosed on five sides by the top wall, bottom wall, first end wall, dividing wall and first side wall and having a first access opening open on the first side of the partition spanning from the first end wall to the dividing wall between the top wall and the bottom wall, a second storage compartment enclosed on five sides by the top wall, bottom wall, second end wall, dividing wall and second side wall and having a second access opening open on the second side of the partition spanning from the second end wall to the dividing wall between the top wall and the bottom wall, a first door on the first side of the partition slidably mounted for linear sliding between a closed position in which the first door closes the first access opening and an open position in which the first door overlies the second side wall and does not cover the first access opening to the first storage compartment, a second door on the second side of the partition slidably mounted for linear sliding between a closed position in which the second door closes the second access opening and an open position in which the second door overlies the first side wall and does not cover the second access opening to the second storage compartment.

BRIEF DESCRIPTION OF THE DRAWINGS

Further aspects and advantages of the invention will become apparent having regard to the following description taken together with the accompanying drawings in which:

FIG. 8 is a top plan view of the wall shown in FIG. 6;

FIG. 9 is a top cross-sectional view of the middle partition shown in FIG. 7 along section line 9–9';

DETAILED DESCRIPTION OF THE DRAWINGS

Figure 1:
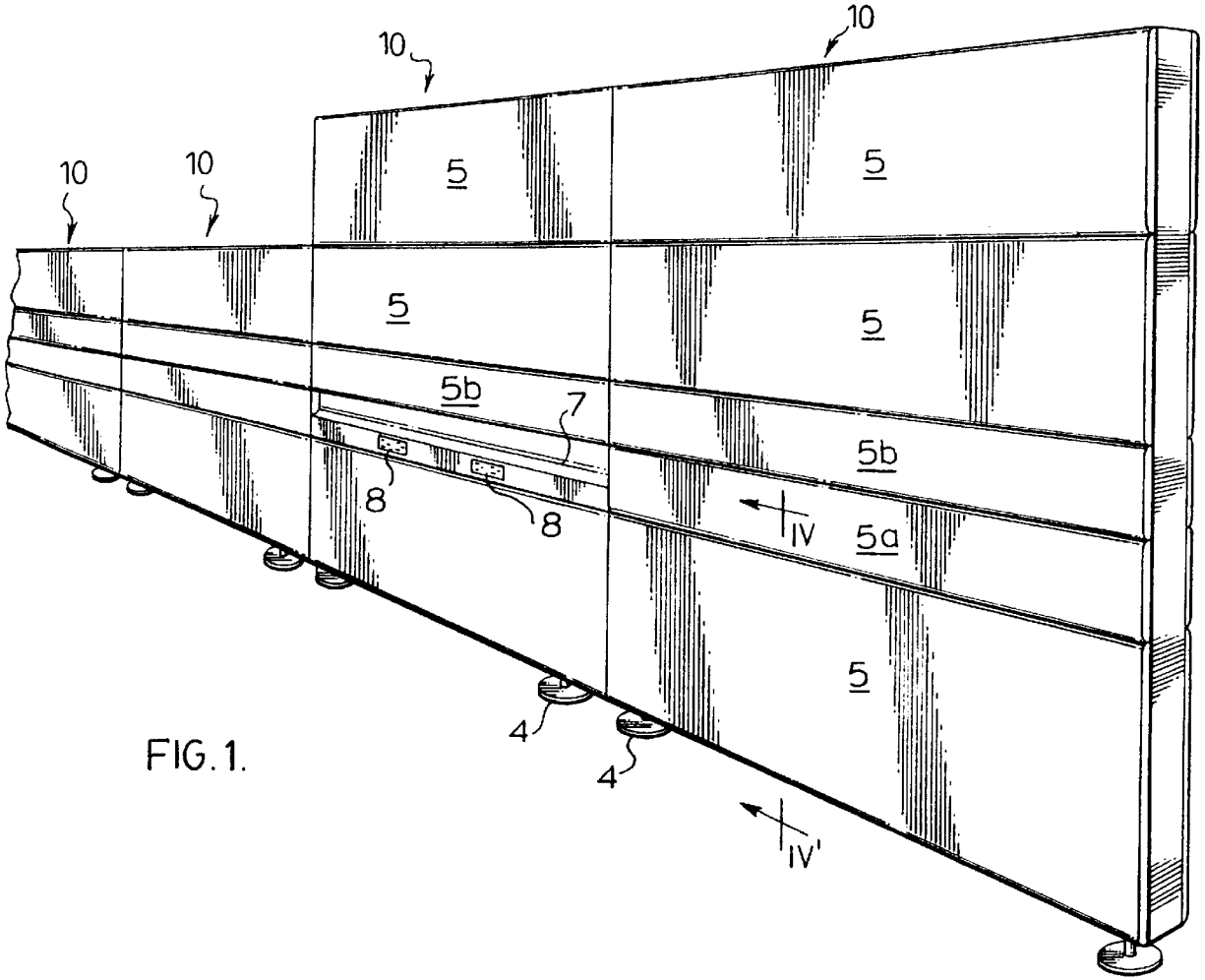
FIG. 1 shows a frontal prospective elevation view of an assembled modular office furniture partition wall including a number of partitions in accordance with U.S. Pat. No. 5,406,760.
Figure 2:
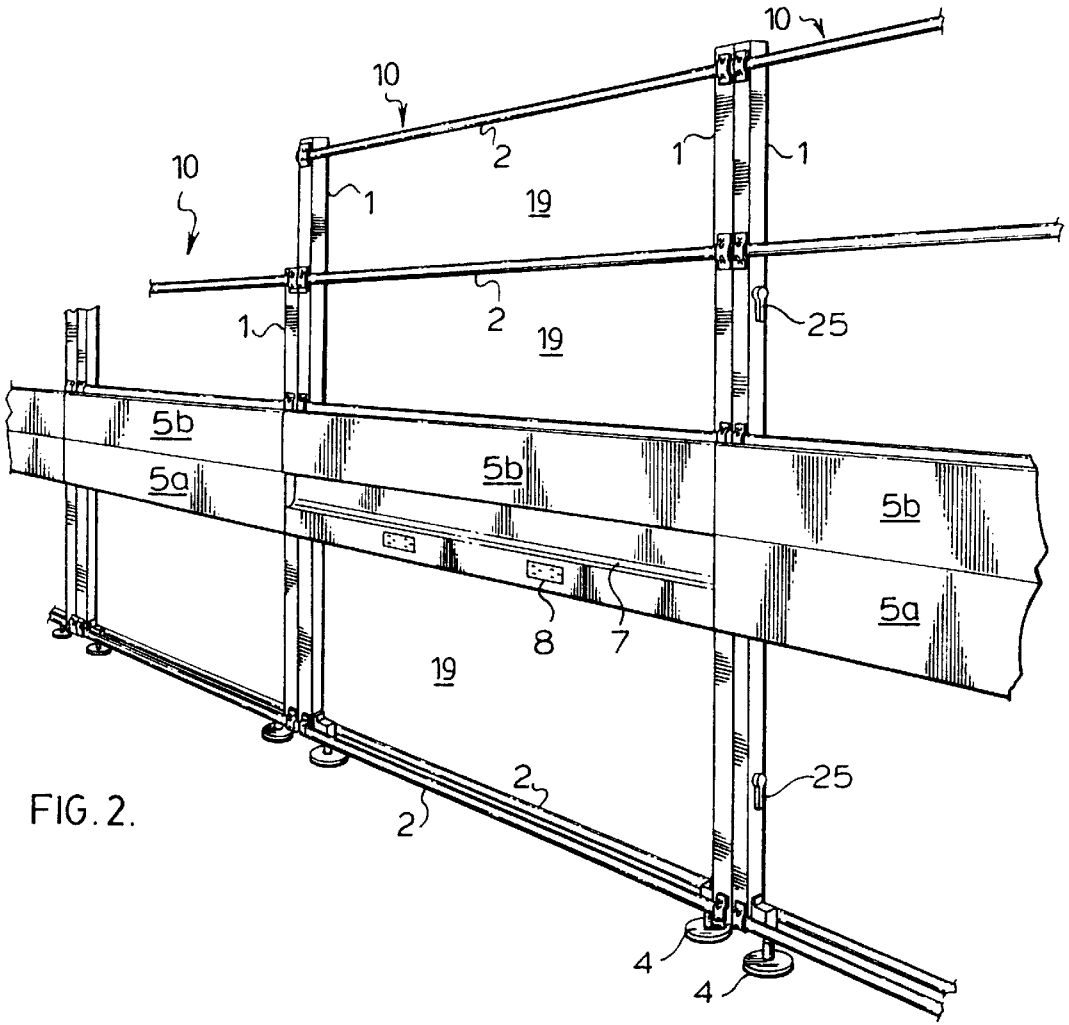
FIG. 2 is a frontal prospective view of the partition wall of FIG. 1 with some of the cladding covers removed to reveal the internal partition frames.
Figure 3:
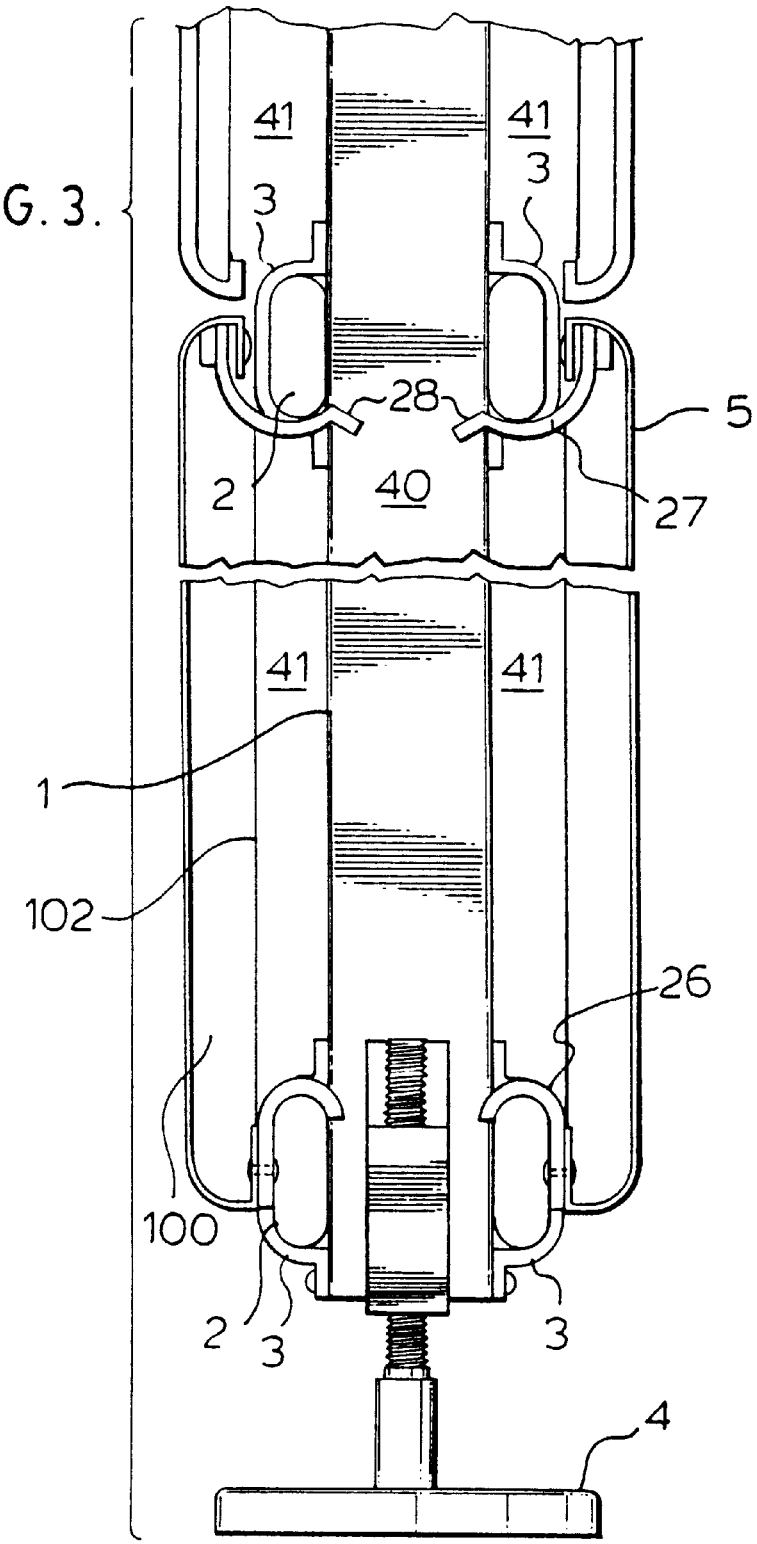
FIG. 3 is a schematic pictorial view illustrating a section on a rectangular frame of a partition of the same construction as that shown in FIGS. 1 and 2.

Each of FIGS. 1, 2, 3 and 4 illustrate a panel assembly in accordance with U.S. Pat. No. 5,406,760, the disclosure of which is incorporated herein by reference. The partition wall illustrated comprises a plurality of rectangular partitions generally indicated 10 shown to be arranged end-to-end for convenience. Each partition comprises a generally rectangular frame including vertical frame members or post 1 and horizontal frame members or beams 2. The beams 2 are preferably arranged in parallel pairs on both sides of each post 1. The beams 2 are connected to the outward opposing front and rear faces of each post 1 in an overlapping moment resisting connection. Both the posts 1 and the beams 2 are shown as tubular in cross-section. The post 1 and beams 2 are connected with brackets 3 having a saddle portion of internal profile mating with the external profile of the beams 2. The brackets 3 include flange portions above and below the saddle portion which overlie and are connected to the outward, forward or rearward face of the associated post 1 as by screws, rivets, welding and the like. The posts 1 of adjacent partitions are connected as shown in FIG. 2 in line with the posts 1 of adjacent partitions as by connectors generally indicated as 25.

Figure 4:
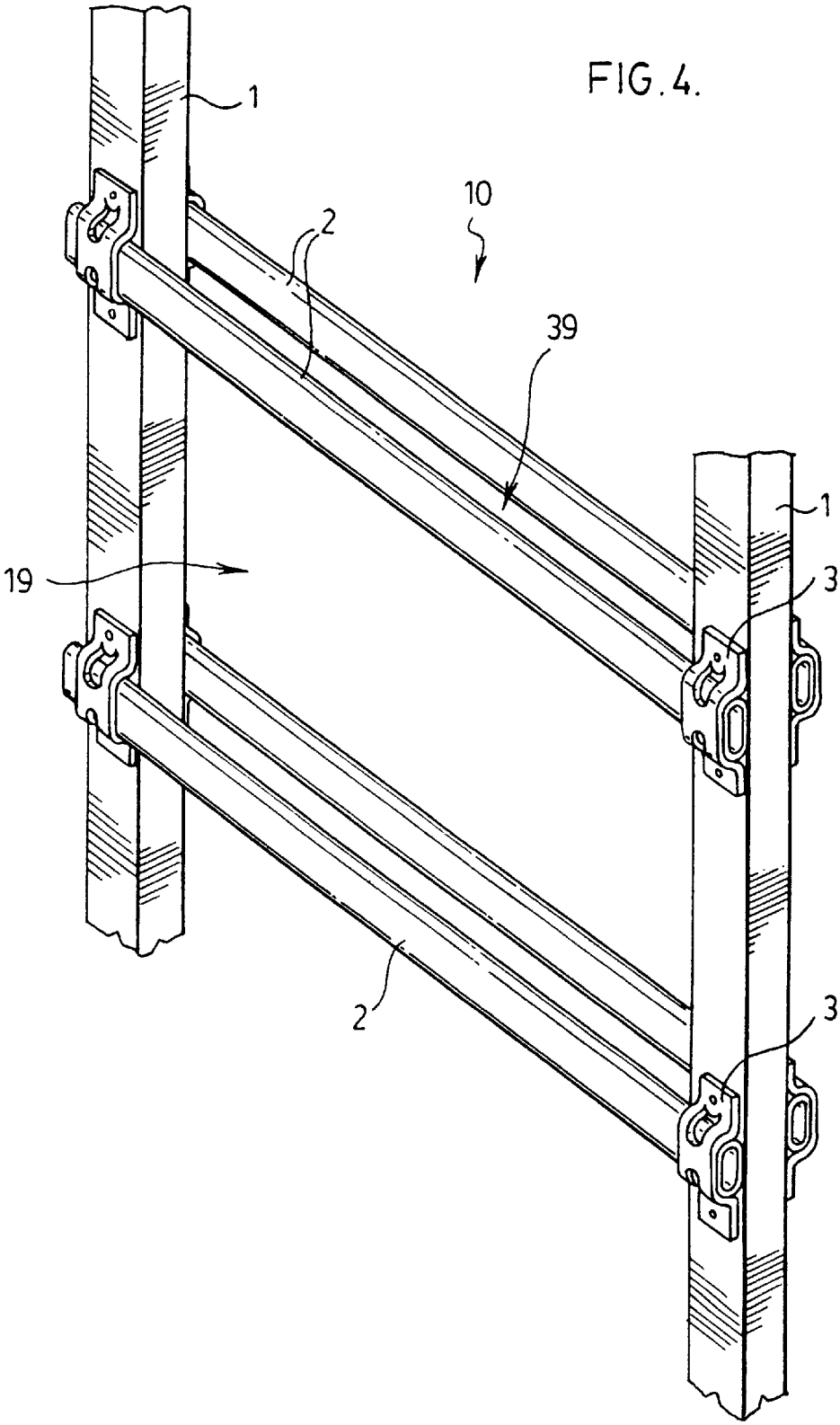
FIG. 4 is a cross-sectional end view through a portion of the partition of FIG. 1 along section line 1V–1V' in FIG. 1.

Cladding covers indicated generally as 5 but also specifically as 5*a* or 5*b* are removably coupled to the frame as best seen in FIGS. 2 and 4 laterally outward of the beams 2. As best seen in FIG. 4, due to the thickness of the brackets 3, a vertical space is present between the beams 2 and inward portions of the covers 5 other than where the brackets are present. Mechanisms are provided for mounting the covers 5 to the frame, however, such mounting mechanisms are not illustrated for the purpose of simplicity. The mounting mechanism preferably comprise resilient clips to engage portions of each covers 5 with the clips preferably secured between adjacent beams 2 or to the post 1. Each cover 5 preferably comprises a skin of sheet metal and having at each end a plastic end plug which assists in maintaining the sheet metal in its desired form. The end plug provides a means for engagement of the mounting mechanisms so as to releasably couple each cover 5 to the frame. As shown, each panel 5 preferably spans between adjacent parallel vertically spaced pairs of beams 2, however, in a middle portion of the partitions there are shown covers 5*a* and 5*b* which do not span between adjacent beams 2 but rather are removably coupled to each frame and generally span half the distance between two adjacent beams 2.

The partition illustrated is to be appreciated as formed with an open gridwork of horizontally spaced, vertical posts 1 and vertically spaced, horizontal beams 2 with the result that the partition has a plurality of rectangular internal openings therebetween through the frame from one side to the other and open internal cavities permit the passage of wires and cables therein. The interior cavity is made up of a vertically extending central post space 39 together with horizontally extending raceways 41 adjacent and open to the central post space 39. The central post space 39 is defined between the posts 1, that is, between a forward plane including the forward face of each post 1 and a rearward plane including a rearward face of each post 1. The central post space 39 extends vertically between the spaced, parallel forward and rearward planes and between interior faces of the post 1. The central post space 39 extends continuously vertically throughout the height of the partition open upwardly to above the top of the partition and open downwardly to below the lowest beam of the partition.

A plurality of raceways 41 extend horizontally between the beams 2 outward of the respective of the forward or rearward planes. The raceways 41 extend a full width of each partition and are open at each end to beyond the exterior end faces of the posts. The raceways 41 are defined inward of the covers 5 and extend forwardly and rearwardly from the respective forward and rearward planes the combined thickness of the beams 2 and the saddle portion of the brackets 3.

The raceways 41 are open on their interior sides to the central post space 39 over the entire distance between the posts 1. Whereas the central post space 39 ends at the interior end faces of the post 1, the raceways 41 provide for passageway for conduit horizontally past the posts outward of the posts inward of the covers. Similarly, the central post space 39 provides a passageway for conduit vertically past the beams 2 inward of the beams and inward of the covers. The raceways 41, central post space 39 and covers 5 define an interior cavity in the panel assembly which permits conduit to be routed vertically throughout the partition between the post 1 inside the beams and horizontally across the partition and between adjacent partitions in the raceways outside the post 1 between the beams 2 and inside the covers 5.

As can be seen in FIGS. 2 and 4, a plurality of rectangular internal openings 19 are defined by the posts and beams of the framework extending through the framework from one side of the framework to the other, with such a rectangular opening provided underlying each of the covers 5.

Figure 6:
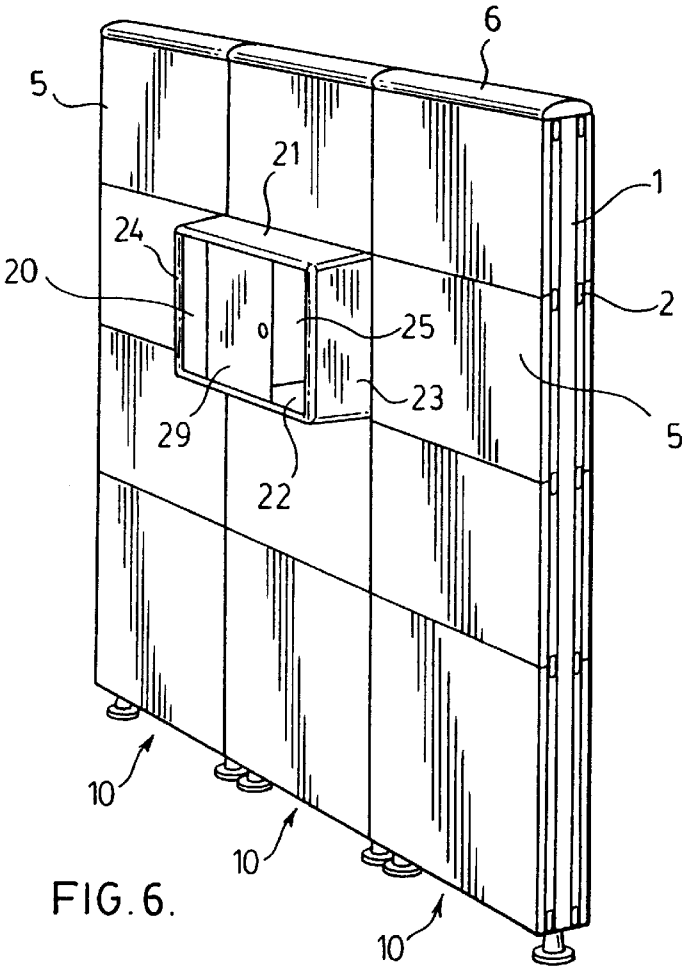
FIG. 6 is a pictorial view of a wall formed of three partitions of the type illustrated in FIGS. 1 to 4 and incorporating a straddle bin having the same configuration as that shown in FIG. 5.

Reference is made to FIGS. 6 to 10 which show a first embodiment of a straddle bin 20 in accordance with the present invention. FIG. 6 shows a wall formed of three partitions 10 of the construction illustrated in FIGS. 1 to 4. Each of the partitions is adapted to be covered by four covers 5 of which the uppermost three covers are of equal size and shape and are removable and interchangeable. The perimeter of each of the covers shown in FIG. 6 overlies at its upper and lower edges, horizontal beams and at its vertical edges, vertical posts. Thus, it is to be appreciated that in FIG. 6, two covers have been removed from each side of the partition leaving a rectangular internal opening therethrough and within which opening the straddle bin 20 is mounted.

Figure 10:
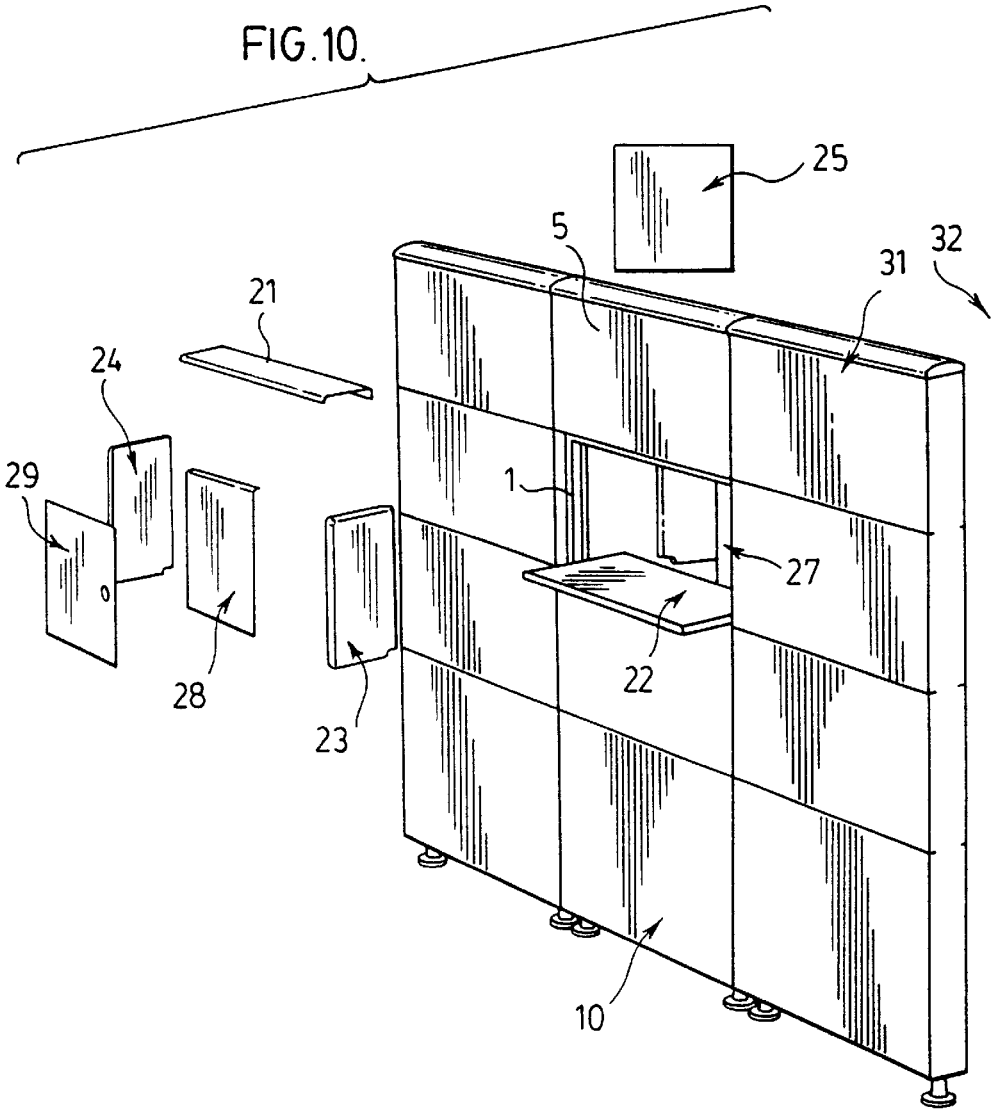
FIG. 10 is a partially exploded view of the wall shown in FIG. 6 showing elements of the straddle bin.

As shown in the drawings and may be understood, particularly in FIG. 10, the straddle bin is formed by two horizontal top wall member 21 and a horizontal bottom wall member 22 spaced vertically from the top wall members. Two vertical first end wall members 23 extend between the top wall members 21 and the bottom wall member 22 at a first end of the straddle bin. Two vertical second end wall members 24 extend between the top wall members 21 and the bottom wall member 22 at a second end of the straddle bin. The top wall member 21 and the bottom wall member 22 extend parallel to each other transversely through the partition 10. Each of the first end members 23 are adapted to be coupled to opposite sides of a post 1 to effectively form with the post a first end wall that extends transversely through the partition. Similarly, each of the second end wall members 24 are secured to a post 1 to effectively form with the post 1 a second end wall parallel the first end wall.

A vertical dividing wall member 25 is provided intermediate the first end wall members 23 and the second end wall members 24 with the dividing wall member extending parallel to the end wall members. The partition for convenience is indicated as having a first side 31 and a second side 32.

On the second side 32 of the partition, a vertical first side wall member 27 is provided spanning from the first end wall member 23 to the dividing wall member 25 between the top wall member 21 and the bottom wall member 22. A first storage compartment 33 is defined enclosed on five sides by the top wall member 21, bottom wall member 22, first end wall members 23, dividing wall member 25 and the first side wall member 27. This first storage compartment 33 has a first access opening 35 open on the first side 31 of the partition and spanning from the first end wall member 23 to the dividing wall member 25 between the top wall member 21 and the bottom wall member 22.

On the first side 31 of the partition, a vertical second side wall member 28 is provided spanning from the second end wall member 24 to the dividing wall member 25 between the top wall member 21 and the bottom wall member 22. A second storage cabinet 34 is defined enclosed on five sides by the top wall member 21, bottom wall member 22, second end wall members 24, dividing wall member 25 and the second side wall member 28. The second storage compartment 34 has a second access opening 36 open on the second side 32 of the partition 10 spanning from the second end wall member 24 to the dividing wall member 25 between the top wall member 21 and the bottom wall member 22.

Thus, it can be seen that the straddle bin 20 defines two storage compartments 33 and 34 adjacent each other, each having a blind end and each opening only to opposite sides of the partition. Doors are provided to close the access openings of each compartment. In this regard, as seen in top view in FIG. 9, the top wall member 21, bottom wall member 22 and the side wall members 23 and 24 extend laterally outwardly beyond the dividing wall member 25 and the first and second side wall members 27 and 28 such that horizontally extending tracks, namely, first tracks 37 on the first side of a partition and second tracks 38 on the second side of the partition provide trackways within which doors 29 and 30 may be slidably received. In this regard, a first door member 29 is provided on the first side 31 of the partition 10 slidably mounted for linear sliding in the first track 37 between a closed position in which the door member 29 closes the first access opening 35 and a open position in which the first door member 29 overlies the second side wall member 28 and does not cover the access opening 35 to the first storage compartment 33. Similarly, a second door member 30 on the second side 32 of the partition 10 is slidably mounted for linear sliding in the second track 38 between a closed position in which the second door member 30 closes the second access opening 36 and a open position in which the second door member 30 overlies the first side wall member 27 and does not cover the access opening 36 to the second storage compartment 34. In FIG. 9, the first door member 29 is shown in a closed position and the second door member 30 is shown in an open position.

Figure 11:
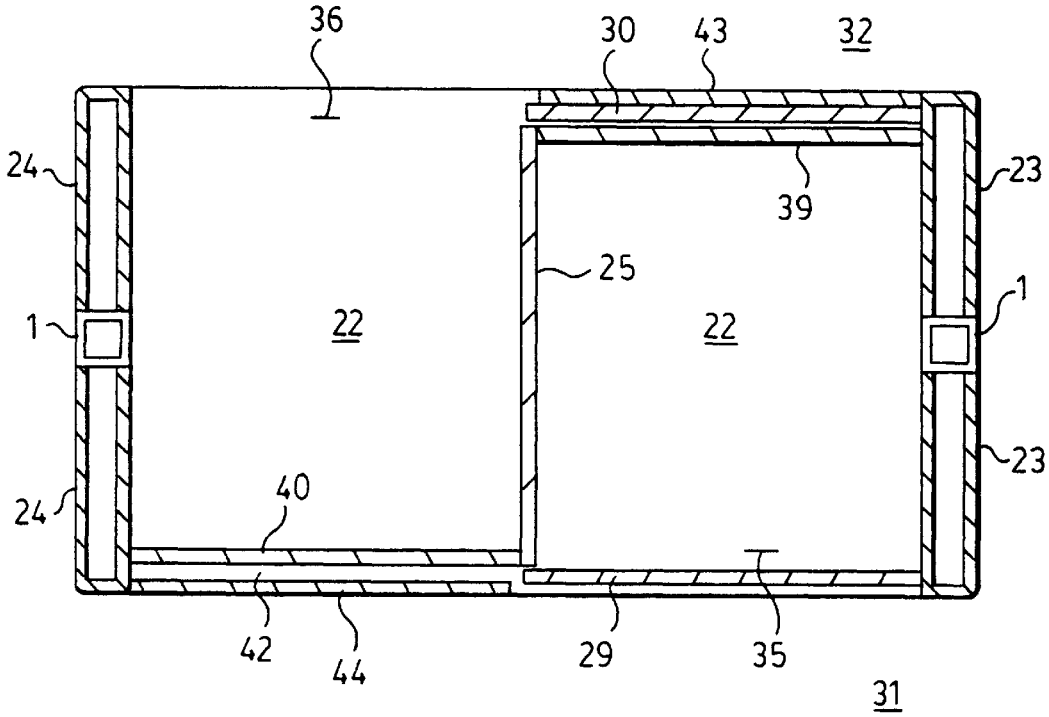
FIG. 11 is a top cross-sectional view similar to that shown in FIG. 9, however, showing an alternative arrangement for the doors.

Reference is made to FIG. 11 which shows a top cross-sectional view similar to that in FIG. 9, however, of an alternate construction in which the first side wall member indicated as 27 in FIG. 9 is replaced by a double wall structure including a first interior side wall member 39 and a first exterior side wall member 43 spaced from each other to form a first door pocket space into which the second door member 30 is slidable. Similarly, the second side wall member 28 is shown as replaced by a double wall structure including a second interior side wall member 40 and a second exterior side wall member 44 defining a second door pocket space 42 therebetween to slidably receive the first door member 29.

The outwardly directed surfaces of the door members and/or the side wall members may serve an additional purpose as preferably comprising a mirror, a whiteboard surface, a blackboard surface, a tack board surface or a magnetic board surface. In this regard, the surfaces could comprise a mirror or have a mirror attached thereto. The surfaces could be used to mount notes as by being a tack board, for example, having a layer of cork secured thereto and to which pins and the like could be stuck or by having a magnetic surface such that magnets could hold notes onto the surface. The surfaces could also be used for carrying markings such as being a whiteboard or blackboard for marking by whiteboard pens or chalk or the like. Similarly, one or more of the surfaces could be provided with a thin frame-like structure so as to serve the purpose as comprising a picture frame within which a photograph or notice or the like could be mounted.

In respect of the embodiment illustrated in FIG. 9, the door members 29 and 30 pass outwardly of first and second side wall members 27 and 28, respectively, and, therefore, the side wall members are more particularly adapted for use as a mirror or picture frame, whiteboard or blackboard and would not be convenient for use as a tack board or magnetic board. However, in the context of the embodiment illustrated in FIG. 11, since the door members 27 and 28 slide inwardly relative to the exterior side wall members 43 and 44, such exterior side wall members may be provided to conveniently be a tack board or a magnetic board. Similarly, the door members in both the embodiments illustrated in FIGS. 9 and 11 could easily comprise mirrors, picture frames, whiteboards or blackboards, however, only the doors illustrated in FIG. 9 would conveniently be tack boards or magnetic boards.

Figure 5:
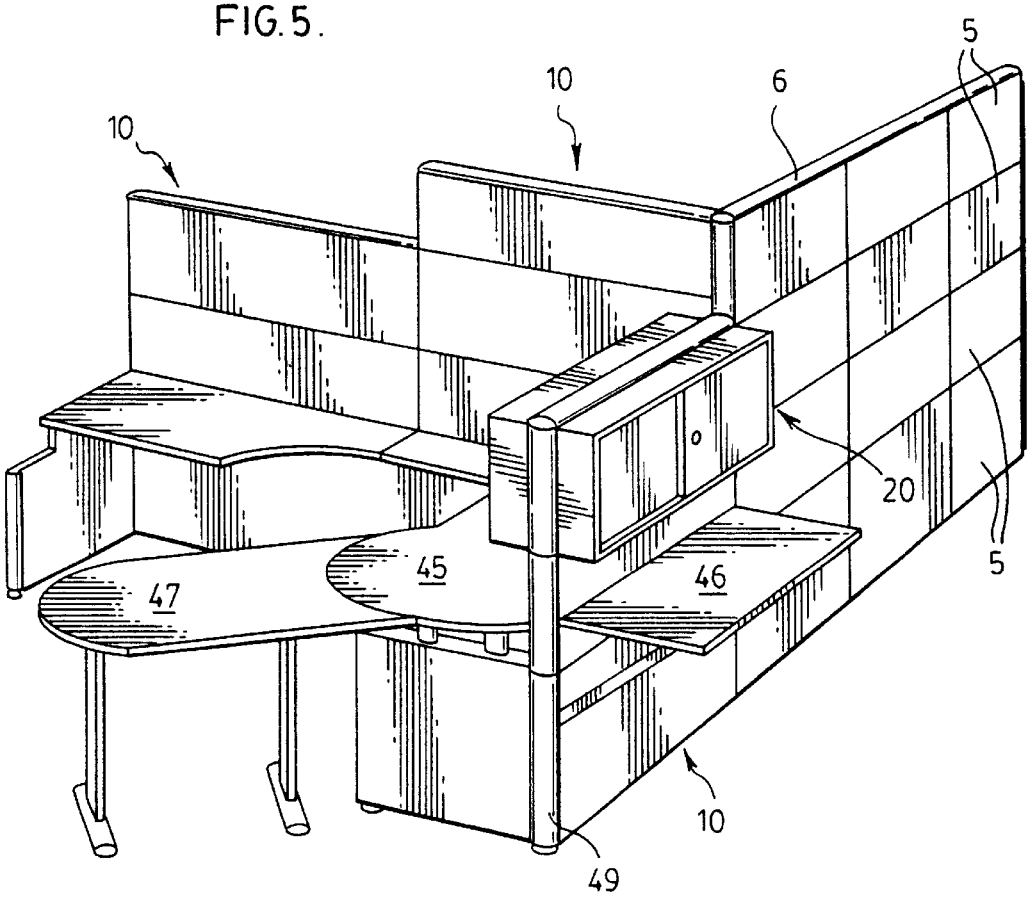
FIG. 5 is a pictorial view of an assembled modular office furniture system utilizing partitions of the type illustrated in FIGS. 1 to 4 and incorporating a straddle bin in accordance with a first embodiment of the present invention as well as desks on either side of a partition forming a wall within the furniture system.
Figure 7:
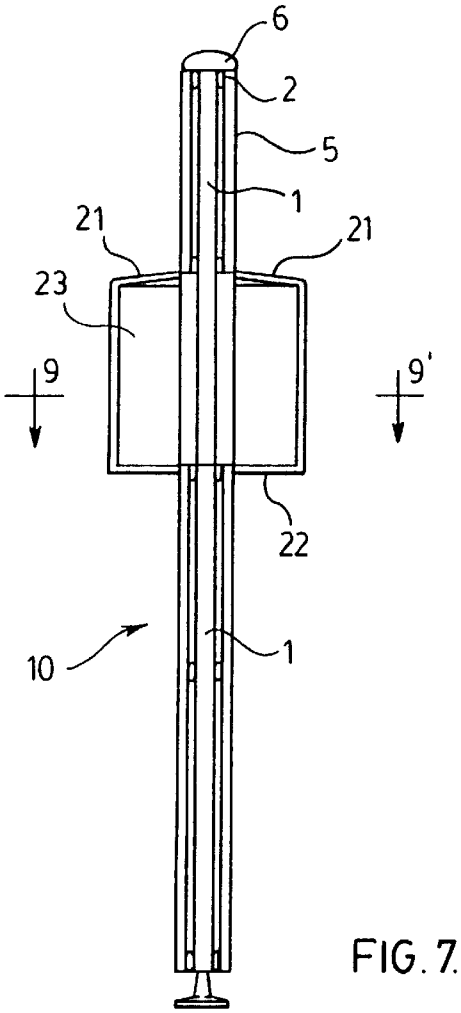
FIG. 7 is an end view of the middle partition shown in FIG. 6.

Reference is made to FIG. 5 which shows a storage bin 20 identical to that illustrated in FIGS. 6 to 10 mounted in a modular office furniture system utilizing partitions as described with reference to FIGS. 1 to 4. In FIG. 5, as in FIG. 6, decorative top caps 6 are attached to the tops of the partitions and decorative end caps 49 are attached to ends of some of the partition. FIG. 5 shows a configuration in which a work station is provided on each side of the partition 10 carrying the straddle bin 20. In this regard, a work station comprising a desk 45 is provided on one side of the partition 10 carrying the straddle bin 20 and a work station comprising a desk 46 is provided on the other side of the partition carrying the straddle bin 20. In this configuration, one of the compartments would be open to the work station on one side of the partition and the other compartment would be open to the work station on the other side of the partition. Desk arrangements are shown comprising desks 45 and 46 which are attached to and modular with the partitions 10, however, separate desks such as the removable desk indicated as 47 could be provided in substitution for the coupled desks 45 and 46.

Figure 12:
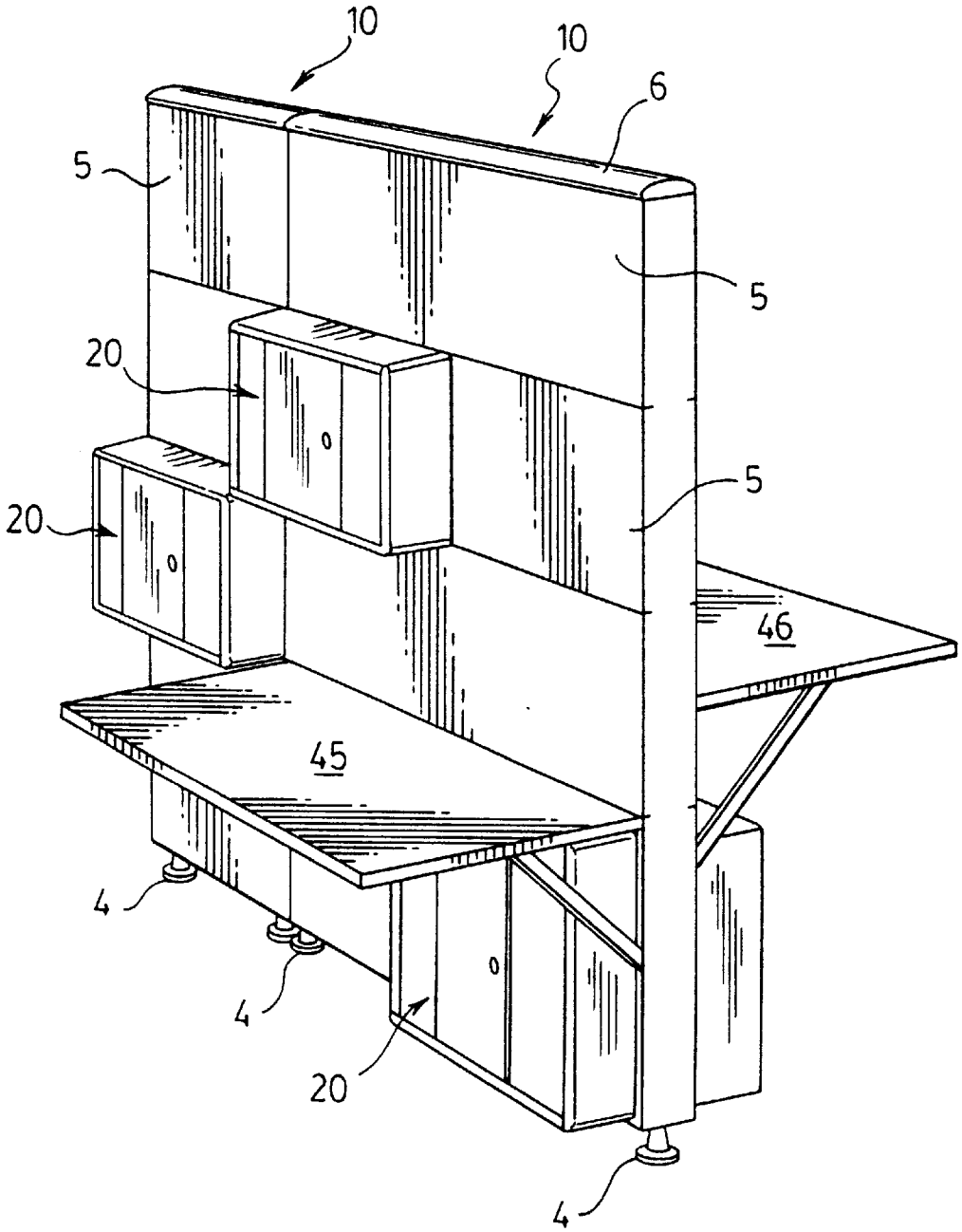
FIG. 12 is a pictorial view of a wall similar to that shown in FIG. 6 with three straddle bins mounted in different positions.

The preferred embodiments illustrated in FIGS. 5 to 11 show the straddle bin 20 as mounted at a height above a table top or desk surface. It is to be appreciated that this is not necessary. FIG. 12 schematically illustrates that straddle bins 20 may be mounted at different heights on the partitions 10 with the embodiment of FIG. 12 intending to indicate positions above a table top, at a table top height or adjacent thereto and below a table top.

The preferred embodiment in FIGS. 5 to 10 illustrates a straddle bin in which the straddle bin extends the width of a partition, that is, from one adjacent post to another post in the partition. It is to be understood that this is not necessary. FIG. 12 illustrates a wall with two partitions 10, one of a length larger and the other of a lesser length. While not shown, each partition has two vertical posts rising at the ends of each partition at the location where the feet 4 are shown. A straddle bin 20 is shown as extending only one half the distance between the posts of the larger length partition to which it is secured. A modular cover 5 is provided adjacent the straddle bin 20 and the larger length partition. The size of this cover is the same as the size of the cover on the lesser width partition 10 shown in FIG. 12.

The preferred embodiments illustrate a particularly preferred arrangement for construction of the straddle bin 20 as with the top wall member 21 and bottom wall member 22 comprising a unitary element and the top wall and end walls each being formed by two end wall members. This is merely preferred and any manner of construction and mounting of the various wall members is within the scope of the present invention.

The present invention has been described with reference to preferred embodiments. Many modifications and variations will now occur to a person skilled in the art. For a definition of the invention, reference is made to the following claims.

I claim:

1. A modular office furniture system comprising:

an upright partition having a first side and a second side, the partition comprising a supporting framework formed of vertically spaced horizontal beams and horizontally spaced vertical posts defining at least one rectangular internal opening therebetween through the framework from one side of the framework to the other side, the partition having cladding on both sides of the framework to cover portions of the framework on each side of the partition, a storage element mounted to the framework within the rectangular opening extending to each side beyond the cladding on that side, the storage element having a horizontal top wall, a horizontal bottom wall spaced vertically from the top wall, a vertical first end wall extending between the top wall and the bottom wall at a first end of the storage element and a vertical second end wall extending between the top wall and the bottom wall at a second end of the storage element parallel to the first end wall, a vertical dividing wall intermediate the first end wall and the second end wall parallel to the first end wall, a vertical first side wall at the second side of the partition spanning from the first end wall to the dividing wall between the top wall and the bottom wall, a vertical second side wall at the first side of the partition spanning from the second end wall to the dividing wall between the top wall and the bottom wall, a first storage compartment enclosed on five sides by the top wall, bottom wall, first end wall, dividing wall and first side wall and having a first access opening open on the first side of the partition spanning from the first end wall to the dividing wall between the top wall and the bottom wall, a second storage compartment enclosed on five sides by the top wall, bottom wall, second end wall, dividing wall and second side wall and having a second access opening open on the second side of the partition spanning from the second end wall to the dividing wall between the top wall and the bottom wall, a first door member on the first side of the partition slidably mounted for linear sliding between a closed position in which the first door member closes the first access opening and an open position in which the first door member overlies the second side wall and does not cover the first access opening to the first storage compartment, a second door member on the second side of the partition slidably mounted for linear sliding between a closed position in which the second door member closes the second access opening and an open position in which the second door member overlies the first side wall and does not cover the second access opening to the second storage compartment.

2. A system as claimed in claim 1 including a first workstation provided adjacent the first side of the partition, a second workstation provided adjacent the second side of the partition.

3. A system as claimed in claim 1 wherein the first door member in the closed position does not cover any portion of the first access opening and the second door member in the closed position does not cover any portion of the second access opening.

4. A system as claimed in claim 1 wherein the framework includes a plurality of rectangular internal openings defined between the horizontal beams and vertical posts, the cladding comprises cladding panels adapted to span between adjacent of the beams on each side of the framework and at least some of the cladding panels are of the same size, the storage element occupying a rectangular opening sized to be covered by an integral number of the modular cladding panels of the same size.

5. A system as claimed in claim 1 wherein the storage element fills the rectangular space with the top wall and bottom wall each closely adjacent a respective horizontal beam and the first end wall and second end wall each engaging a respective vertical post.

6. A system as claimed in claim 1 wherein the first side wall presents directed towards the second side of the partition an element selected from a mirror, a tack board, a whiteboard, a magnetic board and a picture frame.

7. A system as claimed in claim 1 wherein the second side wall presents directed towards the first side of the partition an element selected from a mirror, a tack board, a whiteboard, a magnetic board and a picture frame.

8. A system as claimed in claim 1 including a work table adjacent one of the first side and second side of the partition, the storage element disposed at a height above the height of the work table.

9. A system as claimed in claim 1 including a work table adjacent one of the first side and second side of the partition, the storage element disposed at a height ajdacent the height of the work table.

10. A system as claimed in claim 1 including a work table adjacent one of the first side and second side of the partition, the storage element disposed at a height below the height of the work table.

11. A system as claimed in claim 1 wherein the first door member is mounted for sliding in linear tracks carried by the top wall member and bottom wall member proximate the first side of the partition.

12. A system as claimed in claim 1 wherein the second door member is mounted for sliding in linear tracks carried by the top wall member and bottom wall member proximate the second side of the partition.

13. A system as claimed in claim 1 wherein the first side wall member comprises a double wall comprising a first inner wall member and a first outer wall member with a door receiving space to slidably receive the second door member therebetween.

14. A system as claimed in claim 13 wherein the second side wall member comprises a double wall comprising a second inner wall member and a second outer wall member with a door receiving space to slidably receive the first door therebetween.

15. A system as claimed in claim 1 wherein the top wall member comprises a unitary element which extends from one end of the storage element to the other end of the storage element, the bottom wall member comprises a unitary element which extends from the one end of the storage to the other end of the storage element, the dividing wall member comprises a unitary element which extends through the storage element to each side thereof, the first end wall member comprising two elements, one mounted on each side of the framework, each engaging and secured to the post adjacent thereto, the second end wall member comprising two elements, one mounted on each side of the framework, each engaging and secured to the post adjacent thereto.

16. A system as claimed in claim 13 wherein the outer wall member presenting on its surface directed towards the second side of the partition an element selected from a mirror, a tack board, a whiteboard, a magnetic board and a picture frame.

17. A system as claimed in claim 14 wherein the second outer wall presenting on its surface directed towards the first side of the partition an element selected from a mirror, a tack board, a whiteboard, a magnetic board and a picture frame.

* * * * *